US009546661B2

(12) United States Patent
Eriksson et al.

(10) Patent No.: US 9,546,661 B2
(45) Date of Patent: Jan. 17, 2017

(54) ROTOR MACHINE INTENDED TO FUNCTION AS A PUMP OR AN AGITATOR AND AN IMPELLER FOR SUCH A ROTOR MACHINE

(75) Inventors: Ola Eriksson, Kiruna (SE); Daniel Marjavaara, Kiruna (SE)

(73) Assignee: Luossavaara-Kiirunavaara AB, Luleå (SE)

( * ) Notice: Subject to any disclaimer, the term of this patent is extended or adjusted under 35 U.S.C. 154(b) by 478 days.

(21) Appl. No.: 14/116,116

(22) PCT Filed: May 8, 2012

(86) PCT No.: PCT/SE2012/050487
§ 371 (c)(1),
(2), (4) Date: Nov. 6, 2013

(87) PCT Pub. No.: WO2012/154118
PCT Pub. Date: Nov. 15, 2012

(65) Prior Publication Data

US 2014/0064947 A1 Mar. 6, 2014

(30) Foreign Application Priority Data

May 9, 2011 (SE) ..... 1150409

(51) Int. Cl.
*F04D 29/42* (2006.01)
*F04D 1/04* (2006.01)
(Continued)

(52) U.S. Cl.
CPC ..... *F04D 1/04* (2013.01); *F04D 29/2216* (2013.01); *F04D 29/2255* (2013.01);
(Continued)

(58) Field of Classification Search
CPC F04D 29/2216; F04D 29/2255; F04D 29/242; F05D 2240/301; F05D 2250/51; F05D 2250/52
See application file for complete search history.

(56) References Cited

U.S. PATENT DOCUMENTS 2,046,226 A * 6/1936 Weightman ..... F04D 29/2216 277/513
4,253,798 A 3/1981 Sugiura
(Continued)

OTHER PUBLICATIONS

International Search Report received for PCT Patent Application No. PCT/SE2012/050487, mailed on Jul. 5, 2012, 5 pages.
(Continued)

*Primary Examiner* — Ninh H Nguyen
(74) *Attorney, Agent, or Firm* — Morrison & Foerster LLP

(57) ABSTRACT

The invention concerns a rotor machine and an impeller, of which the rotor machine is intended to function as a liquid pump or as an agitator in a fluid such as a liquid or a colloid, whereby the rotor machine has a pump casing (1) with an impeller (2) mounted in bearings in a manner that allows rotation around an axis (X), and in which the rotor machine has three principal flow pathways, comprising: —an axial inlet opening (4) with a defined area of opening (Ain) —a radially oriented outlet opening (5) with a defined area of opening (Aut), and —a series of radially extending blades (3) that, distributed around the circumference of the impeller, form between them a number of flow channels (22:1-22:*n*). In order to achieve an improved working capacity, the area of opening (Ain) of the inlet opening (4), the area of opening (Aut) of the outlet opening and the total effective area of opening of the flow channels (22:1-22:*n*) that extends through the impeller are so mutually designed that the three principal passages of the rotor machine are filled and emptied of the said fluid in an essentially equal manner.

5 Claims, 2 Drawing Sheets

Figure 1:
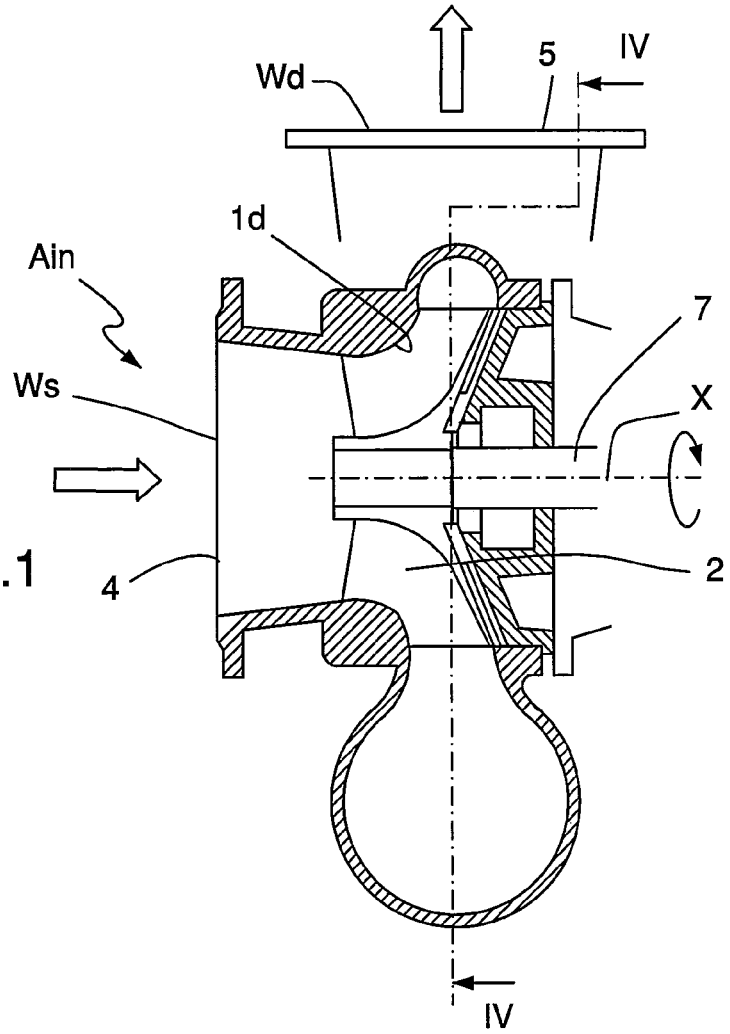

(51) Int. Cl.
*F04D 29/24* (2006.01)
*F04D 29/22* (2006.01)

(52) U.S. Cl.
CPC ..... *F04D 29/242* (2013.01); *F05D 2240/301* (2013.01); *F05D 2250/51* (2013.01); *F05D 2250/52* (2013.01)

(56) References Cited

U.S. PATENT DOCUMENTS

| | | | | |
|---|---|---|---|---|
| 5,316,440 | A | 5/1994 | Kijima et al. | |
| 5,797,724 | A * | 8/1998 | Liu | F04D 7/04 415/203 |
| 6,106,230 | A * | 8/2000 | Burgess | F04D 7/04 415/196 |
| 6,398,494 | B1 | 6/2002 | Clements | |
| 6,779,974 | B2 * | 8/2004 | Chien | F01D 1/02 415/206 |
| 2009/0016895 | A1 * | 1/2009 | Beez | F04D 29/242 416/241 R |
| 2010/0284812 | A1 * | 11/2010 | Zahdeh | F04D 29/24 416/185 |

OTHER PUBLICATIONS

Written Opinion received for PCT Patent Application No. PCT/SE2012/050487 mailed on Apr. 26, 2013, 6 pages.
International Preliminary Report on Patentability received for PCT Patent Application No. PCT/SE2012/050487 completed on Aug. 29, 2013, 6 pages.

* cited by examiner

ROTOR MACHINE INTENDED TO FUNCTION AS A PUMP OR AN AGITATOR AND AN IMPELLER FOR SUCH A ROTOR MACHINE

CROSS REFERENCE TO RELATED APPLICATIONS

This application is a U.S. National Phase patent application of PCT/SE2012/050487, filed on May 8, 2012, which claims priority to Swedish Patent Application No. 1150409-9, filed on May 9, 2011, each of which is hereby incorporated by reference in the present disclosure in its entirety.

The present invention concerns a rotor machine intended to function as a liquid pump or agitator in a fluid such as a liquid or a colloid, for example colloid, emulsion or aerosol. The invention concerns also an impeller for such a rotation machine.

Commercially available rotation machines of the specified type have an impeller that is affixed at the end of a motor shaft. The impeller is normally provided with curved paddles or blades whose thickness becomes smaller out towards the periphery. In addition to conventional pumping work, this type of impeller is used to transport or distribute liquids or gases in a liquid phase in containers, this can be compared to, for example, the type of top-mounted agitator that is commonly found in the manufacturing industry.

Prior art impellers for rotor machines of this type suffer from a number of disadvantages. In particular, they demonstrate a low efficiency due to the appearance of turbulence in the flow of liquid through the impeller. It is known that liquid that is led through flow channels in an impeller or a running wheel in a rotation machine of centrifugal type is influenced by two different types of flow. These two flows are constituted by partly a primary flow—which is the flow that flows along the flow channels, and partly a secondary flow—which is the flow that is generated through displacement of liquid with low energy in the interfaces at wall surfaces and the static pressure gradients that arise in the flow channels. This phenomenon leads to the formation of circulatory eddies or flows that do not have a uniform speed in the flow channels, which in turn results in a considerable loss of flow energy in the impeller, and that the machine is not filled and emptied in an efficient manner.

It is desirable to achieve an impeller that demonstrates improved working capacity when it is used in rotation machines. Thus, what is desirable is an impeller that demonstrates a high outlet speed or efficiency, even when used at a relatively low speed of rotation. Further, it is desirable that the form and design of the impeller blades be so chosen that the formation of steam and of cavitation in the medium that is being transported through the impeller can be avoided, and that filling and emptying of the same is made more efficient.

A first purpose of the present invention is to achieve a rotor machine of the specified type with improved working capacity. A second purpose of the invention is to achieve an impeller with an improved working capacity, and one intended to be used at a rotation machine of the type specified above.

This first purpose of the invention is achieved through a rotor machine that has received the distinctive features and characteristics that are specified in claim 1, and the said second purpose is achieved through an impeller that demonstrates the distinctive features and characteristics that are specified in claim 5.

Further advantages of the invention are made clear by the non-independent claims, to which reference is also made.

The insight that forms the basis of the invention is that problems normally arise due to dimensional and areal variations in transitions between flow channelways, and that low efficiency is normally caused by flow separation that is caused by rapid retardation or rapid increase in pressure in flows to and from an inlet and an outlet. This is solved, according to the invention, through the area of the inlet opening, the area of the outlet opening and the total effective opening area of the flow channel [sig, singular?] that stretches through the impeller having been given such mutual forms that the three principal channels of the rotor machine are filled and emptied of liquid in a similar manner.

Figure 2:
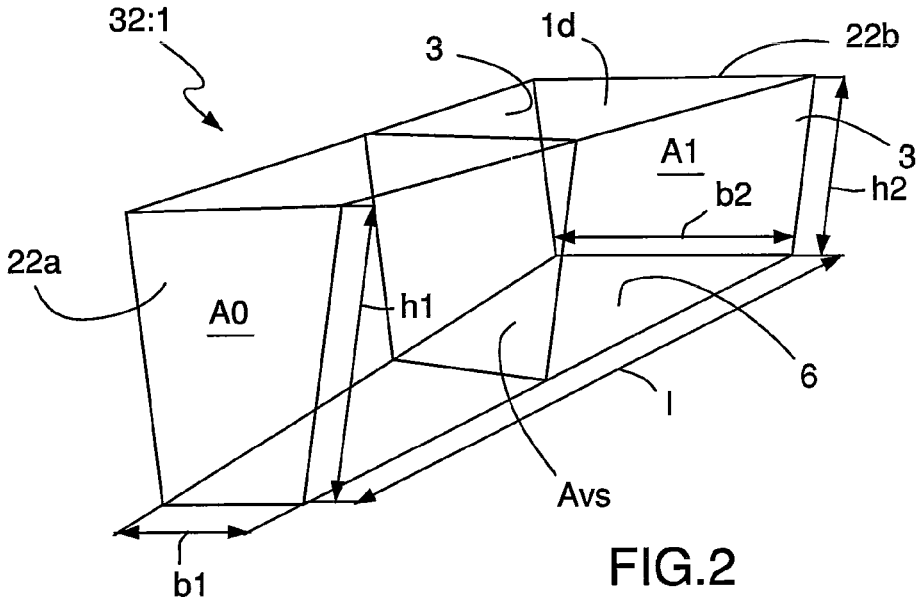
Figure 3:
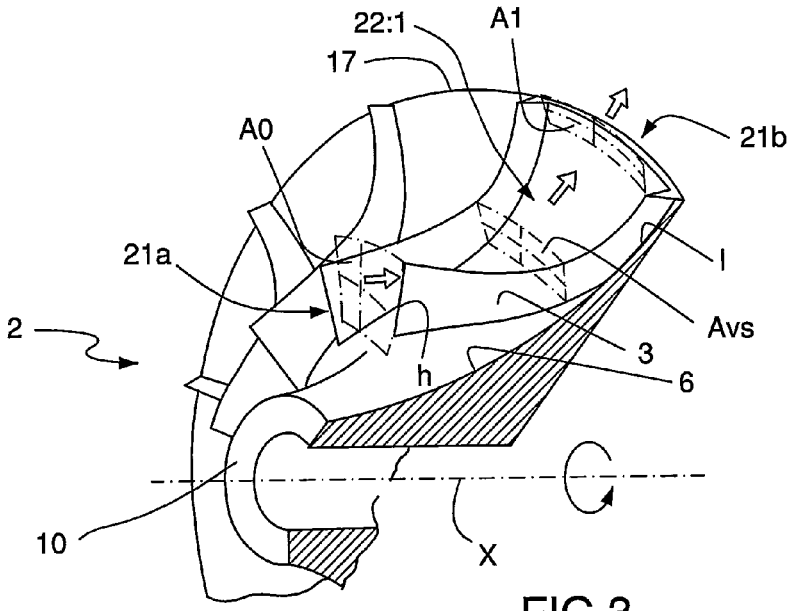
Figure 4:
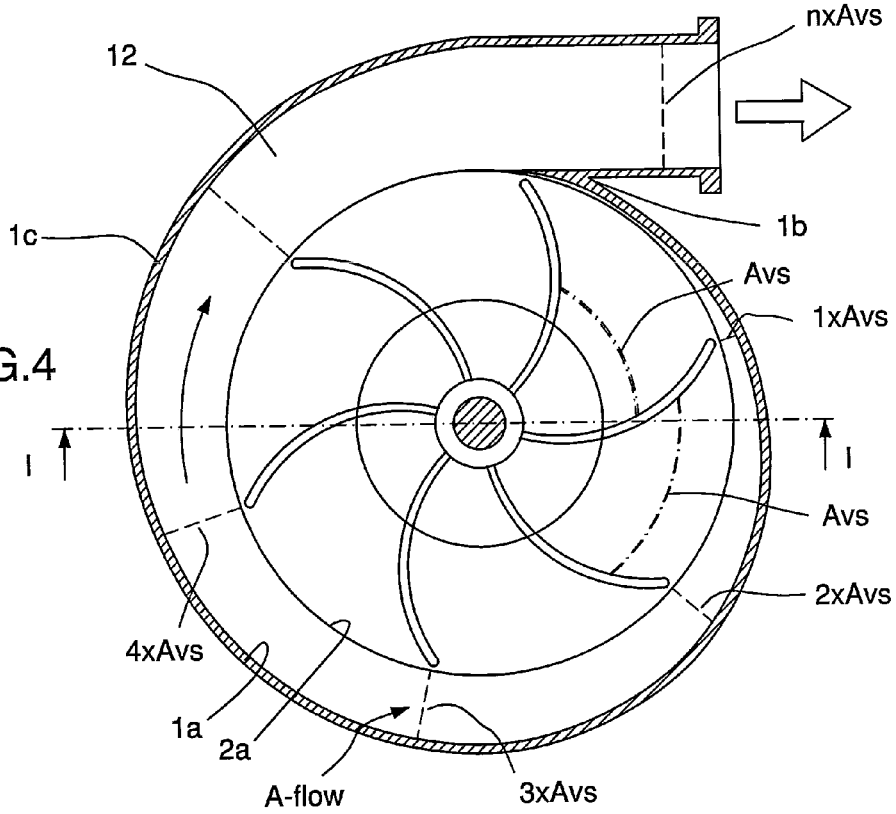

The invention will be described in more detail below with reference to the attached drawings, of which:

FIG. 1 shows a longitudinal section through a rotor machine according to the invention with an impeller mounted in it, which arrangement is shown with partly removed pieces, FIG. 2 shows a graphical view of an imaginary flow channel formed by adjacent blades on the impeller whereby the form of the flow channel varies between its inlet opening and its outlet opening, but where the two openings demonstrate constant cross-sectional areas, FIG. 3 shows a perspective view of a part of an impeller that is a component of the rotor machine that illustrates the flow profiles of the medium through the channel that is limited between adjacent blades of the impeller, and FIG. 4 shows a cross section through the rotor machine according to the line IV-IV in FIG. 1.

FIG. 1 shows a rotor machine of centrifugal type that in the embodiment described here is intended to function as a liquid or fluid pump, and that in a somewhat modified design would be able to function as an agitator. The rotor machine comprises a spiral pump casing 1, i.e. what is known as a "diffuser", with a shell housing demonstrating an inner limiting wall 1*a* that expands radially outwards relative to the outer periphery 2*a* of an impeller 2 that works within the pump casing. This impeller 2 is provided with blades 3 or wings around its circumference. The shell housing deviates in both the axial and the radial directions based on a starting point 1*b* towards a predetermined point 1*c* of the limiting wall 1*a*, in order to increase the cross-sectional area A-flow of the fluid pathway in the direction towards an output location. The shell-shaped compartment of the pump casing 1 has a suction inlet 4 and a pressurised outlet 5 for the fluid. The impeller 2 has a radially extended cover sheet that forms a support surface 6 for the blades 3. The impeller 2 is mounted in bearings on a shaft 7 in a manner that allows rotation and it is driven by a power supply, not shown for reasons of clarity, in the direction of the arrow and in a direction X of rotation. A fluid is drawn by suction in an axial direction as a consequence of the rotation of the impeller 2, i.e. it is drawn along the longitudinal direction of the shaft through the suction inlet 4 into the spiral pump casing and it is output in a radial direction through the pressurised outlet 5. The blades 3 of the impeller 2 demonstrate a profiled contour that curves backwards from the direction of rotation. Fluid that has been drawn in through the suction inlet 4 to the impeller 2 is transported through the blades of the impeller in a radial direction and inside the spiral pump casing 1 towards the pressurised outlet 5, through which the fluid leaves the rotation machine. Reference number 10 denotes the thickened hub by which the impeller 2 is fixed attached to the shaft 7. The specifications of drawing in the following description are made relative to this axis X of rotation, unless otherwise specified. The flow through the rotor machine is defined as the volume of fluid per unit time ($m^3/s$), and the speed of flow is the speed of the flow. This is specified in meters per second (m/s).

A fluid that has been drawn into the pump casing 1 through the suction inlet is denoted on the drawings by the arrow Ws, whereby the cross-sectional area of the suction inlet is denoted Ain. The broadest central part of the impeller 2 with respect to its diameter at its periphery 2*a* is somewhat less than the internal diameter of the pump chamber 1 and the said parts are so mutually designed that a ring gap 12 that gradually becomes wider is formed, the cross-sectional area A-flow of which, viewed in the radial direction, gradually increases in the direction of flow of the medium towards the pressurised outlet 5. The said ring gap 12 thus forms a fluid pathway that surrounds the impeller 2 along a part of its circumference 2*a*, while the cross-sectional area A-flow of the fluid pathway increases stepwise in the direction towards the pressurised outlet 5 of the pump casing 1 (see, in particular, FIG. 4). The pressurised outlet 5 is oriented radially with respect to the chamber 1 and forms part of the pressurised side and pressurised outlet of the rotation machine, labelled with the arrow Wd. The cross-sectional area of the pressurised outlet 5 is denoted by Aut. As has been described above, a fluid is drawn through the suction inlet 4 into the pump casing 1, as is shown by the arrow Ws.

The impeller 2 is shown in a perspective view in FIG. 3, whereby it is made clear that the support surface 6 is radially extended and oriented in a plane that is perpendicular to the axis of rotation X. The blades 3 extend from the support surface 6 not only axially upwards with a height denoted by (h), but also radially outwards towards the ring gap 12 that essentially surrounds the pump casing 1, whereby the length of the blades is denoted by (I). The said blades 3 extend perpendicularly from the principal surface of the support surface 6 and in a radial direction, to be more precise—between a rear end 21*a* that faces the hub 10 and a front peripheral end 21*b*. The blades 3 are evenly distributed around the circumference of the support surface 6 such that they form between them a series of a number (n) of flow channels 22:1-22:*n*, where each such flow channel has an inlet 23*a* at the rear end 21*a* of the adjacent blades that faces the axis of rotation X and an outlet 23*b* at the radially forward or free end 21*b* of the adjacent blades. The cross-sectional area is denoted by A0 for the said inlet 21*a*, while the cross-sectional area of the said outlet 21*b* is denoted by A1. Each flow channel 22:1-22:*n* has a nominal cross-sectional area denoted by Avs. The term "nominal" is used below to denote the smallest effective area of a flow channel 22:1-22:*n*, i.e. the cross-section in a flow channel 22:1-22:*n* at the impeller 2 where the flow area is a minimum. It should, thus, be understood that the total flow area or area of opening through the impeller 2, denoted by A-impl, is obtained as the product of Avs and the number (n) of flow channels.

FIG. 2 illustrates schematically a flow channel 22:1 at the impeller 2 whereby the said cross-sectional areas A0 and A1 are in this case defined for reasons of simplicity as the product of the distance (b) between adjacent blades 3 and the heights (h) of these in the axial direction, i.e. A0=b1×h1 and A1=b2×h2. The nominal cross-sectional area Avs is thus considered to be an infinitely thin volume segment that may be located at any freely chosen point along the length of the flow channel 22:1 (see also FIG. 3). As has been described above, the rotor machine forms a centrifugal pump in that fluid during the rotation of the impeller 2 is thrown from the flow channels 22:1-22:*n* towards the ring gap 12, such that it from there flows onwards out from the pump casing through the pressurised outlet 5. The outgoing flow from the flow channels 22:1-22:*n* gives rise to negative pressure that draws liquid in through the suction inlet 4 to the impeller 2. The expression "blade 3" will be used in the following to denote a flat or curved element that can be rotated around an axis in order to achieve a difference in pressure that causes a gaseous or liquid medium to be redistributed and change its direction of flow. It is appropriate that the blades 3 become thinner with their thickest part in association with the centre of rotation or hub 10 of the impeller 2, and they are in this case singly curved, i.e. demonstrating curvature in one plane only. The blades 3 may, as an alternative, be double curved such as paddles, i.e. demonstrating curvature in several planes.

What has been described above constitutes essentially prior art technology and as such does not relate to the present invention.

Once again with reference to FIG. 1 and FIG. 4, the suction inlet 4 of the pump casing 1, generally directed in a first axial direction, has been given, as has been described above, a certain area Ain, and the pressurised outlet 5 of the pump casing, generally directed in a second axial direction, has been given a certain area Aut. According to the present invention, these two openings have the same area, Ain=Aut, i.e. Ain/Aut is preferably equal to 1.0, or the said ratio lies in the interval 0.9-1.1. During the rotational movement of the impeller 2 inside the shell-shaped working chamber of the pump casing, a hydrodynamic transfer is achieved, whereby the fluid leaves the rotor machine through a flow out from the pump casing 1 as is illustrated by the arrow Wd.

The impeller 2 is shown in FIG. 4 in a plan view, whereby the impeller 2 in the illustrated example has six blades 3, which are directed backwards relative to the direction of rotation of the impeller. Thus six (n) flow channels 22:1-22:*n* are defined between adjacent blades 3, the widths of which channels, denoted b, may be constant, while this is not necessarily the case. According to the invention, the total flow-through or opening area Atot-impl of the rotor machine for fluid through the impeller 2 is obtained as the product of the nominal cross-sectional area Avs and the number (n) of flow channels 22:1-22:*n* across the support surface 6 of the impeller 2. An important distinctive feature of the present invention, in addition to the inlet area Ain and the outlet area Aut of the pump casing 1 being essentially equal, is the feature that the total opening area Atot-impl of the impeller 2, given by Atot-impl=n×Avs, is equal to the said inlet area Ain and outlet area Aut at the pump casing 1. In a similar manner, the cross-sectional area A-flow of the fluid pathway that is limited between the outer periphery of the impeller 2 and the shell-shaped surrounding inner limiting wall 1*a* of the pump casing 1 has been chosen to expand in the radial direction in a predetermined manner such that a gentle and gradually expanding fluid pathway is limited. To be more precise, the outer wall of the pump casing expands following the shell form radially outwards from the periphery of the impeller 2 in such a manner that the cross-sectional area A-flow increases stepwise such that it continuously expands, starting from a point 1*b* for the shell, such that the cross-sectional area A-flow at any given point 1*c* of the cross-sectional area A-flow of the flow pathway along the inner surface 1*a* of the shell corresponds to the opening area Atot-impl for the effective number (n-eff) of the flow channels A-impl of the impeller 2 that are located between the said starting point 1*b* and a given point 1*c* along the inner surface 1*a* of the shell. Another way of saying this is: Atot-impl=n-eff×Avs, where n-eff is constituted by the current number (n) of effective flow channels that are located between the said starting point 1*b* and a given step (n) at a determined end point 1*c* of the shell.

When designing a rotor machine of the present type the dimensions of the following four flow pathways and areas must be carefully considered during the constructive design, namely:

the suction inlet 4 and the area Ain, the pressurised outlet 5 and the area Aut, the total opening area Atot-impl of the impeller for the sum of the flow channels 22:1-22:*n* through the impeller, calculated as Atot-impl=n×Avs, where the expression Avs concerns the nominal area of each flow channel, and the radial expansion of the shell with its cross-sectional area A-flow, where Atot-impl=n-eff×Avs and n-eff is constituted by the current effective number (n) of flow channels that are located between the starting point 1*b* of the shell and a given end point 1*c* of the shell.

In summary, the present invention is based on the conclusions that the efficiency of the rotor machine can be improved by ensuring that the ratios between Ain, Aut and Atot-impl are essentially equal to 1.0, or that the ratio between any one of these mutual parts lies in the interval 0.9-1.1.

FIG. 2 shows schematically a profile through a flow channel 22:1 of the impeller 2, given as an example, in which it should be realised that this type of flow channel can demonstrate a freely chosen form. The profile A0 defines the cross-sectional area of the inlet opening 22*a*, while A1 defines the cross-sectional area of the outlet opening 22*b*. The sides of the illustrated flow channel 22:1 are limited by two adjacent opposing blades 3, the bottom of the flow channel 22:1 is limited by a part of the support surface 6 and its upper surface by a part of the end cover 1*d* that is a component of the pump casing. The nominal volume of the flow channel is calculated from length (l)×nominal cross-sectional area (Avs). The opposing upper and lower surfaces 1*d*, 6 and the opposing side surfaces 3 that limit the specific flow channel 22:1 may diverge away from or converge towards each other in the direction of flow of the flow channel. The expressions "diverging channel" and "converging channel" are used below to denote that two of the opposing limiting surfaces of the channel diverge or converge, respectively, from parallelism in an axial direction. It is, however, important according to the present invention that any change of shape of the flow channel is achieved with a constant cross-sectional area across the complete length of the flow channel 22:1. Another way of saying this is that, independently of the geometrical cross-sectional form of the flow channel 22:1, the mutual distance between opposing surfaces and how they converge and diverge relative to each other in the flow channel, it is important that the flow channel 22:1 be so designed that the ratio A0/A1 is always essentially equal to 1.0, whereby A0 is the inlet area of the flow channel and A1 is the outlet area of the flow channel. The ratio between A0 and A1, thus, should be equal to 1.0 or, in any case, it should lie in the interval 0.9-1.1, i.e. the areal ratio A0/A1 is preferably close to or equal to 1.0.

The reference symbol Avs is used in FIG. 3 to denote the nominal cross-sectional area of an infinitely thin volume segment that is located at a freely chosen point along the length of the specified flow channel 22:1 whereby the total volume of the flow channel, or—to be more precise—its flow capacity, is defined by a number of volume segments that follow after each other. Another way of saying this is that the flow capacity of the flow channel 22:1 is the sum of a freely chosen number of such volume segments Avs across the channel, where the integration limits are constituted by the radial length of the flow channel 32:1. The ratio between a nominal area determined in advance and the volume segment Avs that is displaced along a flow pathway between the inlet opening 22*a* of the flow channel 22:1 and its outlet opening 22*b* shall, according to the invention, be equal to 1.0, or in any case lie within the interval 0.9-1.1, i.e. it should deviate by only approximately 10% from the nominal value Avs of the cross-sectional area. The relationship between a volume segment with a nominal cross-sectional area Avs that is displaced between the inlet opening 22*a* of the flow channel 22:1 and its outlet opening 22*b* should, thus, demonstrate not only the same cross-sectional area along the complete integration distance (the length of the channel), but also the same cross-sectional area as the said inlet or outlet. Another way of saying this is that the measured deviation from the nominal cross-sectional area in the flow channel, i.e. Delta Avs (ΔAvs) should lie in the interval 0.9-1.1. Another way of saying this is that the cross-sectional form of the flow channel 22:1 may vary but the nominal cross-sectional area Avs of an infinitely thin volume segment that moves between the inlet and the outlet should, according to the invention, be essentially constant.

One of the major advantages of the present design of the flow channel 22:1, or to be more precise, of all of the flow channels 22:1-22:*n* of the impeller 2, with a constant nominal cross-sectional area Avs along its length, is that the flow channel will be filled and emptied in the same manner. This will be the case, despite the fact that it is appropriate that the width of the flow channel 22:1 at its inlet opening 22*a* that is located at the axis X of rotation demonstrates an essentially axially extended surface area while the outlet opening 22*b* at its peripheral end that faces away from the axis X of rotation demonstrates a radially extended surface area. From the point of view of dimensioning and flow parameters, the said surface area of the inlet and outlet, respectively, gives a significant advantage. The term "axial extended form" is used to denote that the inlet 22*a* of the flow channel 22:1 demonstrates a height (h) in the axial direction that is larger than that of the outlet 22*b*. The inlet 22*a* of the flow channel is, in the same way, more narrow and demonstrates a smaller width (b) than that of the outlet 22*b*.

The invention is not limited to that which has been described above and shown in the drawings: it can be changed and modified in several different ways within the scope of the innovative concept defined by the attached patent claims.

The invention claimed is:

1. A rotor machine configured to function as a liquid pump or as an agitator in a fluid, the rotor machine comprising:

a pump casing with an impeller mounted in bearings in a manner that allows rotation around an axis (X), an axial suction inlet with a defined area of opening (Ain);

a radial pressurised outlet with a defined area of opening (Aut); and a series of radially extending blades that, distributed around a circumference of the impeller, form between them a number (n) of flow channels that each has a nominal cross-sectional area (Avs) and which channels together form a total nominal area of opening (Atot-impl) through the impeller, wherein the rotor machine has three principal flow pathways (Ain, Aut, Atot-impl), the area of opening (Ain) of the suction inlet, the area of opening (Aut) of the pressurised outlet and the total nominal area of opening (Atot-impl) of the flow channels that extend through the impeller are mutually designed such that a ratio of areas of opening between any two of the three principal flow pathways (Ain, Aut, Atot-impl) of the rotor machine lies in a range of 0.9-1.1.

2. The rotor machine according to claim 1, whereby the total nominal area of opening (Atot-impl) of the number (n) of nominal cross-sectional areas (Avs) that are located at a freely chosen point along a flow pathway between the inlet and the outlet in each one of the said flow channels is equal not only to the area of opening (Ain) of the suction inlet but also to the area of opening (Aut) of the pressurised outlet, i.e. the ratio between any one of the three principal flow pathways (Ain, Aut, Atot-impl) of the machine is equal to 1.0.

3. The rotor machine according to claim 1, whereby the area of opening (Ain) of the suction inlet is equal to the area of opening (Aut) of the pressurised outlet and equal to the total nominal area of opening of all flow channels of the impeller.

4. The rotor machine according to claim 1, comprising a combination of any one of the following conditions:

that Ain/Aut lies in the interval 0.9-1.1 that Atot-impl/Ain lies in the interval 0.9-1.1 that Atot-impl/Aut lies in the interval 0.9-1.1 that Atot-flow/A-impl(n-eff) lies in the interval 0.9-1.1 that A0/A1 lies in the interval 0.9-1.1 that ΔAvs for one flow channel lies in the interval 0.9-1.1 where Ain is the area of opening of the suction inlet where Aut is the area of opening of the pressurised outlet where Atot-impl is the sum of the nominal cross-sectional area (Avs) of each flow channel where A-flow is a cross-sectional area of a ring channel formed in the shell, and n-eff is the number (n) of effective flow channels between a starting point and an ending point at the shell where A0 is the area of opening of an inlet and A1 is the area of opening of an outlet of a flow channel where ΔAvs is the deviation from a nominal cross-sectional area (Avs) of a volume segment that is displaced between the inlet and the outlet of a flow channel.

5. An impeller for a rotor machine configured to function as a liquid pump or as an agitator in a fluid, and which impeller is configured to be mounted in bearings in a manner that allows rotation for rotation around an axis (X) in a pump casing that is a component of a rotor machine, the impeller comprising:

a radially extended support surface that is oriented in a plane that is perpendicular to the axis of rotation; and a series of radially extending blades that are supported by the support surface, the blades being distributed around a circumference of the impeller, and forming between themselves a series of flow channels where each flow channel has an inlet opening directed towards the axis of rotation with an area of inlet (A0) and an outlet opening directed radially outwards with an outlet area (A1), wherein each flow channel is so designed that with respect to a volume segment with a nominal cross-sectional area (Avs) that may be located at a freely chosen point along a flow pathway between the inlet opening of the flow channel and its outlet opening, any cross-sectional area along the complete length of the flow channel has a maximum deviation (ΔAvs) from the nominal cross-sectional area (Avs) which lies in a range of 0.9-1.1, the blades that limit between them the flow channel with respect to their width in the principal plane of the impeller perpendicular to the axis of rotation (X) diverge from each other in the direction of flow of the flow channel such that each one of the said flow channels demonstrates a greater radial width at its outlet opening than at its inlet opening, a center portion of the support surface extends above the blades along the axis of rotation and each of the blades has an apex at the top thereof.

* * * * *